US005539645A

United States Patent [19]

Mandhyan et al.

[11] Patent Number: 5,539,645

[45] Date of Patent: Jul. 23, 1996

[54] TRAFFIC MONITORING SYSTEM WITH REDUCED COMMUNICATIONS REQUIREMENTS

[75] Inventors: Indur B. Mandhyan, Croton-on-Hudson; Karen I. Trovato, Putnam Valley, both of N.Y.

[73] Assignee: Philips Electronics North America Corporation, New York, N.Y.

[21] Appl. No.: 155,060

[22] Filed: Nov. 19, 1993

[51] Int. Cl.[6] ..... G08G 1/09; G06G 7/76

[52] U.S. Cl. ..... 364/438; 364/436; 340/905; 340/995

[58] Field of Search ..... 364/436, 424.02, 364/461, 438; 340/905, 995, 996; 348/149

[56] References Cited

U.S. PATENT DOCUMENTS

| | | | |
|---|---|---|---|
| 4,591,823 | 5/1986 | Horvat | 340/53 |
| 4,744,083 | 5/1988 | O'Neill et al. | 371/22 |
| 4,792,803 | 12/1988 | Madnick et al. | 340/905 |
| 5,126,941 | 6/1992 | Gurmu et al. | 364/424.02 |
| 5,153,836 | 10/1992 | Fraughton et al. | 364/461 |
| 5,164,904 | 11/1992 | Sumner | 364/436 |
| 5,182,555 | 1/1993 | Sumner | 340/905 |
| 5,247,439 | 9/1993 | Gurmu et al. | 364/424.02 |
| 5,297,049 | 3/1994 | Gurmu et al. | 364/436 |

*Primary Examiner*—Kevin J. Teska
*Assistant Examiner*—Thai Phan
*Attorney, Agent, or Firm*—David R. Treacy

[57] ABSTRACT

Monitoring of traffic on selected routes requires little communication time, through reporting only instances of abnormal speed. During a calibration phase calibrant vehicles are operated along the selected routes with sufficient frequency and for enough days to provide meaningful data. Each calibrant vehicle carries a differential GPS receiver for measuring location accurately. Average speeds for intervals of, for example, 15 seconds, are stored, with the time and place of observation. The data from all calibrant vehicles are then analyzed to determine patterns of mean speed and bandwidth. In the monitoring phase probe vehicles are deployed, each carrying similar GPS, a computer in which the patterns are stored, and a radio for automatically reporting speeds which are out of bandwidth for that time and place.

23 Claims, 3 Drawing Sheets

TRAFFIC MONITORING SYSTEM WITH REDUCED COMMUNICATIONS REQUIREMENTS

BACKGROUND OF THE INVENTION

1. Field of the Invention

The invention relates to the field of monitoring movement of traffic along predetermined routes, where individual moving elements can move with a high degree of discretion as to speed except when congestion, accident or the like limit speeds. In particular, the invention is applicable to monitoring the flow of motor vehicles along urban or suburban roads and highways which are subject to delays of sufficient frequency and severity that corrective action or dissemination of information announcing a delay are economically desirable.

The principle of the invention is applicable to any situation in which movement is primarily limited to forward progress along a defined path or guideway, or transfer at intersections with other defined paths or guideways, and where there are limitations on the possibility of dodging around slowly moving or stopped elements. Thus, as used in the following description and claims, the term "vehicle" should be broadly interpreted and is not limited to wheeled vehicles or objects moving on land surfaces.

Information about traffic flow, and particularly about unusual deviations from the flow which would be "normal" or expected for that route at that time and the general area weather conditions, allows emergency vehicles to be dispatched to trouble spots before specific reports of accidents or the like are available; allows people or vehicle operators to choose alternate routes to avoid delays; and can be invaluable for improving the accuracy of traffic engineering studies.

2. Description of the Prior Art

Since telephone service has become widely available, volunteer anecdotal reporting of abnormal conditions has been one of the most important sources of information about highway traffic flow. Aerial scanning by reporters in small planes is highly effective for the relatively limited areas which can be viewed in any period of time, but this is quite expensive and becomes inoperative when weather conditions make it most valuable. Surveillance devices such as TV cameras can provide information on all lanes of a multi-lane roadway at one location, but have a high unit cost, and are a target for theft or vandalism. Further, none of the systems described above provide outputs which are readily processed by computers.

Direct speed measuring devices, such as Doppler radar, are quite expensive. While they can readily provide outputs which can be received and processed by computers, they may not provide accurate data for stop-and-go traffic in a traffic jam.

Simple, low cost detectors can be used, but they do not usually provide speed data directly. For example, inductive pick-up loops can be installed in highway surfaces, with connections to a central processor. Such a system is shown summarily in a brochure for "California PATH", University of California, Bldg. 452 Richmond Field Station, 1301 S. 46th Street, Richmond, Calif. 94804. However, not only is it expensive to install a sufficient number of such sensors along any one highway, communication of the sensors with the central processor will require a great amount of cabling, or dedication of a substantial transmission spectrum. Local processing, to provide accurate speed data independent of the size of or space between vehicles, may be required, thereby increasing installation and maintenance cost considerably. Further, the sensor/communication failure rate has been estimated to be about 20% per year. Buried sensors require disturbances in the road surface and underlayment, and thus can be a cause of accelerated roadway deterioration. As a result the relatively high cost of fixed monitoring devices, and the continuing cost of communication with each of them, preclude installing such devices at a sufficient number of locations to provide detailed information for a large area.

Many organizations are now involved in planning, studies and tests of systems for improving the flow or safety of highway travel. Over 40 of these are referred to in *Strategic Plan for Intelligent Vehicle-Highway Systems in the United States,* Report No. IVHS-AMER-92-3, published by the Intelligent Vehicle-Highway Society of America. Particular projects involving collection of traffic flow information include PATH (referred to above), GUIDESTAR (Minneapolis, Minn.), TRAVTEK (Orlando, Fla.; already completed) and ADVANCE (Chicago, Ill.). However, none of these have proposed a system for accurate deviation-oriented data collection and dissemination which can minimize the required volume of communications on a day-to-day basis.

Partly because of the high installation costs which would accompany the systems proposed to date, the highway traveler today seldom sees any example of high-technology traveler information systems. Recently, major highways in many areas have signs urging motorists to report accidents via cellular telephones; this method of collecting information avoids high costs of installing equipment which will be little utilized, and can provide coverage of almost every significant event. However, it suffers the problem that some problems are reported by too many people, thereby tying up communications channels and the dispatchers who receive the information; some problems are not reported at all; and anecdotal reporting is subject to severe quantitative inaccuracy because of subjective interpretation and the fact that drivers are too involved with driving their vehicles to note average speeds or the location with sufficient accuracy.

SUMMARY OF THE INVENTION

According to the invention, a system for accurate, automatic deviation oriented monitoring of traffic flow involves deploying calibrant vehicles for collecting and reporting detailed information which describes vehicle speeds actually being experienced along the routes of interest; and loading all this information into a central station computer, where the data are processed statistically to yield mean values, variances, mean and standard deviation of bandwidths and mean and standard deviation of speeds as a function of time of day, segment location, category of day, weather, and common but irregularly occurring events which are reported to the system by other information channels. The computer output forms baseline data against which observations at a particular time, category, weather, event and location can be compared, to identify the existence of abnormal conditions, and to quantify the abnormality.

The baseline data may then be used for multiple purposes: for example, the mean and standard deviation of bandwidth are used to determine the dispatch interval of probe vehicles required to achieve a given statistical accuracy of traffic data (this determines the minimum number of vehicles which should be equipped to report conditions during the regular monitoring phase); and mean and standard deviation of speed are used to program probe vehicles, which are operated on the highways (or paths or guideways) and measure conditions on a regular basis, so that the probe vehicles report only unusual conditions (probe speed out of allowed deviation from the mean). A dispatcher and/or similar central computer may select and control the rate of reporting as a function of time and location along segments of the routes being monitored.

Because the inventive system does not require installation of any hardware in or along any roads or other pathways along which vehicle flow is to be monitored, the system can be deployed quickly. Further, once the equipment for calibrant vehicles (and/or probe vehicles) and central processing has been acquired, the monitoring system can readily be expanded to cover additional routes. Monitoring can be transferred to a substitute route in the event, for example, of unexpected closing of a major route because of a catastrophe.

In a preferred embodiment, most or all of the probe vehicles are motor vehicles which are expected to be routinely traveling the desired roadway route segments while conducting normal other business. Each vehicle is equipped with a differential Global Positioning System (GPS) receiver, a small computer, and a cellular phone or other mobile transceiver for reporting to one of a number of receiving stations. Operation is fully automatic, the on-board system being linked to the ignition system and/or transmission controls, so that it reports only when it is being driven. This embodiment involves the lowest possible long term operating costs, because no or only a few probe vehicle communications are required.

DESCRIPTION OF THE PREFERRED EMBODIMENT

Figure 1:
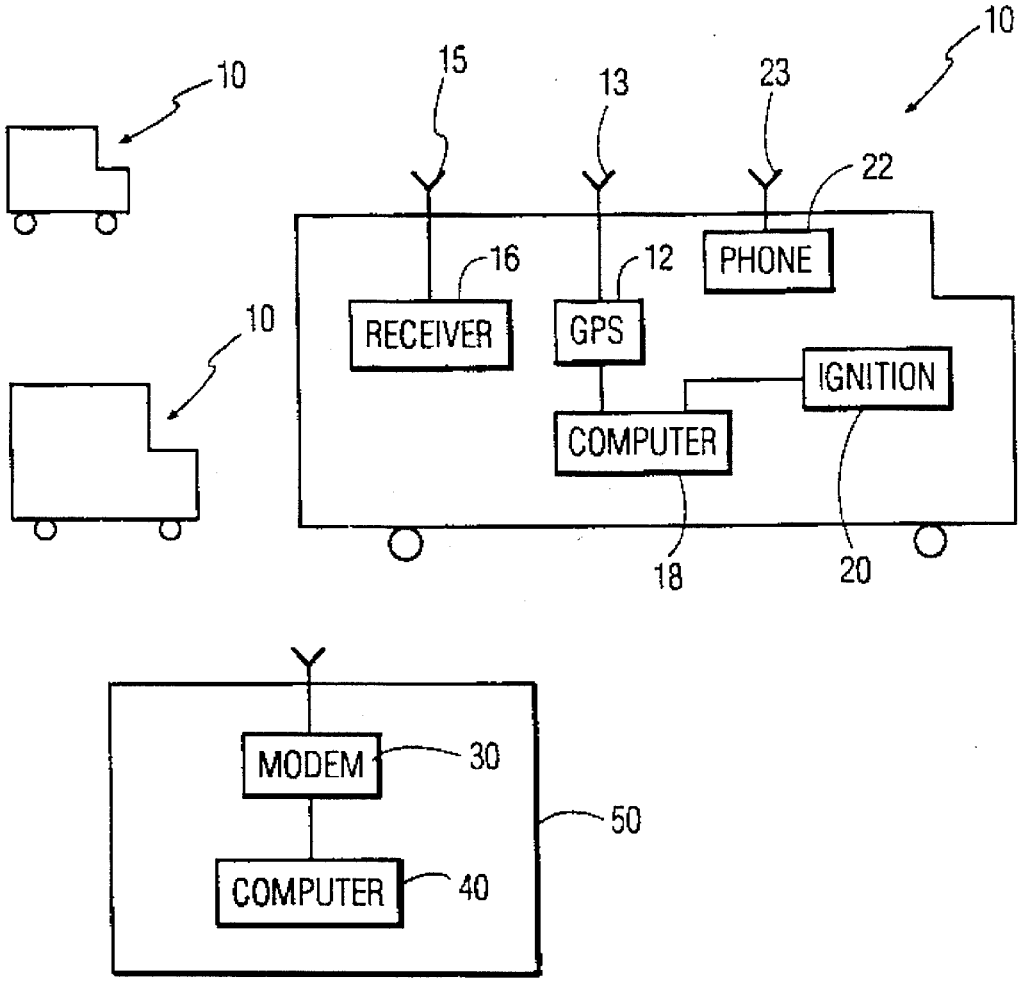
FIG. 1 is a diagram of a system according to the invention while data are being collected in the calibration stage.
Figure 2:
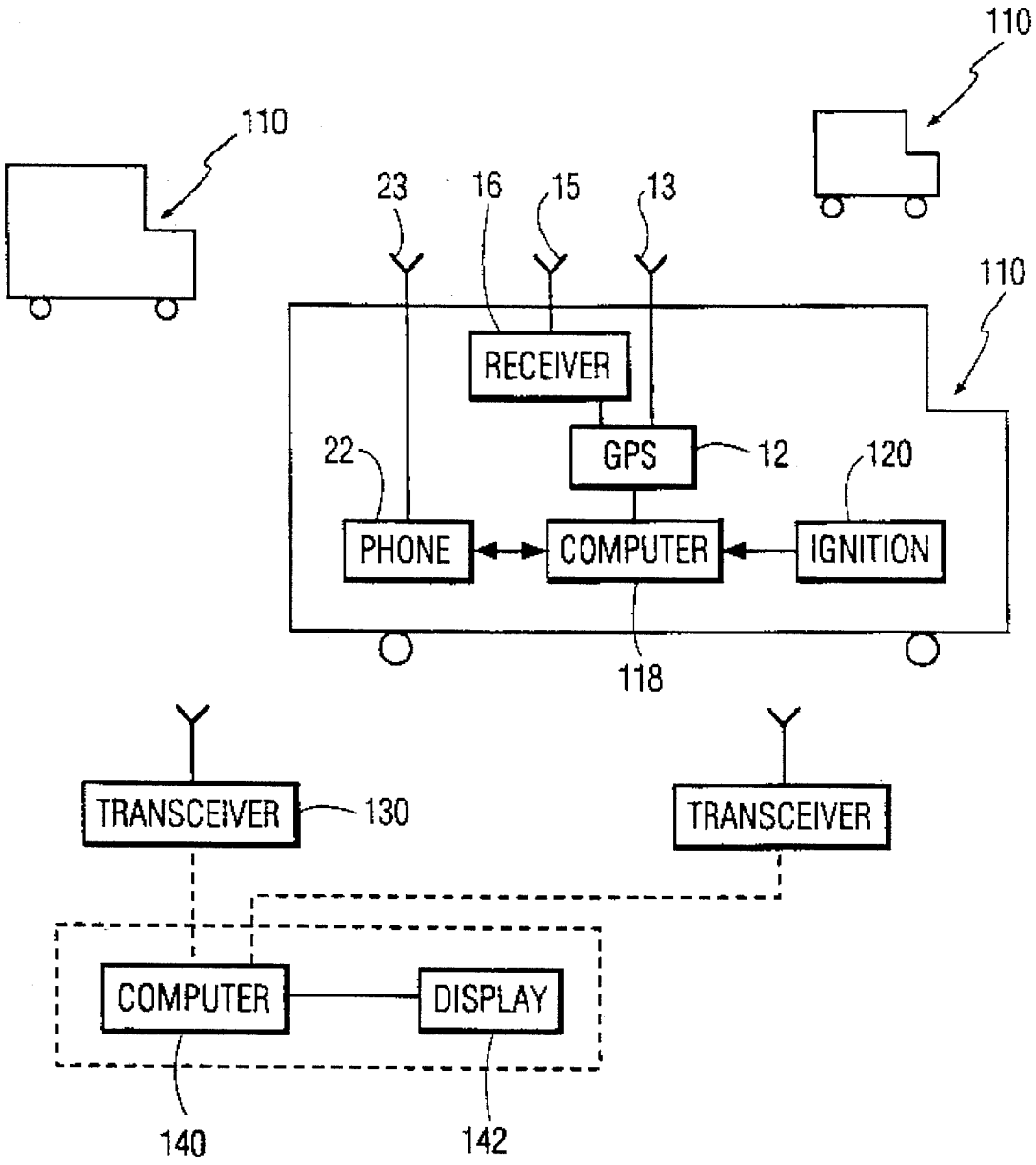
FIG. 2 is a diagram of a system configured for routine reporting of abnormal conditions during the monitoring phase.

A total system operated according to the invention includes equipment shown diagrammatically in FIG. 1 during the calibration phase, and equipment shown diagrammatically in FIG. 2 during the monitoring phase.

Calibration Phase

During the calibration phase, a substantial number of calibrant vehicles 10 will be deployed. Factors involved in selecting this number will be described below. Each calibrant vehicle 10 is equipped with a location sensing system, such as a GPS receiver 12. A GPS antenna 13 is mounted in a convenient location on or near the vehicle roof. For monitoring traffic on closely spaced roadways, it is desirable to obtain position information accurate to approximately one meter; for example, 0.5 meter. This permits distinguishing lane changes, and the particular lane of a multi-lane roadway being travelled. The time of each position reading must also be recorded, but this is readily available in most computers (high relative accuracy) and from GPS receivers (high absolute accuracy).

Because military security considerations have caused governmental agencies to add noise to the transmitted GPS signals, the commercial GPS systems produce location data accurate to only perhaps 30 meters. However, a GPS receiver operated at a known, fixed location can be used to provide a differential correcting signal, which is then transmitted to a differential receiver, for example over an FM sub-carrier to another antenna 15 connected to a special FM receiver 16 in the vehicle. The receiver 16 then communicates the differential information to the GPS. Of course, the differential signal receiver and GPS unit can be integrated into one box.

A computer 18, such as a laptop computer, is installed in the vehicle 10. This computer has data inputs from the GPS receiver 12 and from the vehicle ignition or control system 20. Position readings are taken, and the time and position is stored, frequently; for example, every 5 seconds. Position readings may be recorded as latitude and longitude. Although the GPS system may provide a direct velocity output value, it will usually be undesirable to use this reading because it reflects an average calculated for a time period which may not reflect traffic flow as being modeled. For terrestrial highway travel, any altitude data which may be available will usually be ignored. The total number of readings in a nominal 8-hour day is then between 5000 and 6000, so that storage capacity is not a problem even with a small laptop computer.

A cellular phone 22 may optionally be included. This provides an opportunity for driver communication with a dispatcher at a central station. However, this phone will not ordinarily be used for frequent reporting. Instead, to reduce communication cost during the calibration period, data may be transferred by storing it on a floppy disc which is periodically carried to the computer 40.

Alternatively, for transmitting stored data to a modem 30 which is then functioning as the communications port for a data receiving station, the vehicle operator may establish a connection from the laptop computer (via a modem not shown) to the vehicle phone, or may carry the laptop to a telephone at home or office to transmit the data via the telephone network 31 and modem 30 to a central computer 40 for compiling and statistically evaluating the data collected from all the calibrant vehicles 10.

The calibration phase will involve, for each route to be monitored, a number of days sufficient to provide a minimum level of confidence in the resulting estimates, such as four weeks during each season. The number of calibrant vehicles involves a trade-off between minimizing the number of weeks or months required to obtain statistically significant data and the cost of vehicle leases, equipment purchase or lease, and driver selection and training. Where the routes of interest are relatively long or slow, an individual calibrant vehicle may be able to make only one useful one-way trip during the peak traffic period. Another factor to be considered is traffic diversion to alternate routes, resulting from drivers' reactions to existing radio reports of conditions or reactions to perceived patterns of the recent past. Thus on a given day it may be desirable to provide at least some coverage on selected routes which are generally parallel to a route which is receiving full calibration coverage.

An initial decision must be made as to the number of routes to be covered simultaneously, and the degree to which "fine-grain" analysis is to be provided for any route. There is an obvious choice between deploying a larger fleet of calibrant vehicles, so as to cover a greater number of routes during a given period of time, thereby completing the entire calibration phase sooner; and a lower initial investment in equipment and personnel by using a sufficient fleet to cover a smaller number of routes simultaneously, and stretching the calibration phase over a greater number of months. A pattern equivalent to 20 days (5 days per week, for 4 weeks) of full coverage per route is suggested.

Because of long-term effects like highway construction, climatic variation over the course of a year, or anticipated seasonal or special-occasion variations in traffic volume, on any given route the calibration days or weeks may not be planned for successive days or weeks. Where extensive interleaving of coverage days for various routes is used, computer analysis of the data may uncover correlations between the data patterns which are not readily recognized by a human, and therefore can improve the accuracy both of modeling and of subsequent reporting or prediction based on probe data during the monitoring phase.

The dispatching/data recording protocol during calibration may, for example, call for dispatching another calibration vehicle every 5 to 15 minutes during rush hour or other busy times. While the calibration system is in an operating mode, for example while the ignition is turned on, at the predetermined intervals of time (at least every 15 seconds, and preferably every 5 seconds or more often) the latitude, longitude and time are recorded by the computer 18. To minimize use of radio or telephone transmission channel space and expense, as described above, during calibration the computer will store all the data for one or more trips, or for a half-day or day's travel or even longer. The information is stored on, or copied onto, a floppy disc which is physically delivered to the central computer; or, if the distances involved are substantial, delivered to a computer receiving station for transmission over a computer network or a telephone line. Typical floppy discs can store about 2 months of data stored continuously at 5 second intervals.

In order to improve the accuracy of the models constructed from the calibration data, it may also be desirable to record other data available automatically at the calibrant vehicle. For example, operation of the windshield wipers for more than a windshield washer interval indicates precipitation. If an electronic sensor monitors outside temperature, this can be used to determine whether it is probably rain or something worse. If the wipers are operating in an intermittent mode, the rain is not heavy; while if they are operating at highest speed, rain is probably heavy. Depending on laws and driver training, operation of the headlights may indicate darkness; otherwise, a photo sensor may advantageously provide data to be recorded, whether it is bright, heavily overcast, or dark.

Modeling

A special feature of the invention is the use made of the raw calibration data. The essential quantity of interest is vehicle speed. However, physical constraints place limits on the time variations of the speed, which implies that the spectrum of the speed signals is limited. Thus these signals may be viewed as a Band-limited Stochastic Process.

Figure 3:
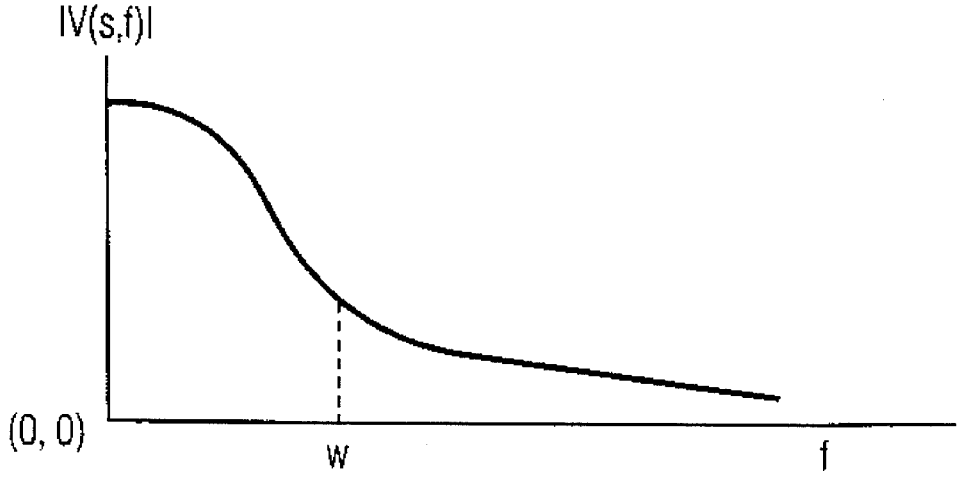
FIG. 3 is a graph of the distribution of speeds which may be observed for a particular segment of a route.

Because the spectrum and bandwidth of the speed signals normally change slowly, in a given interval of time they will have a constant mean and variance. This "given interval" is specific to the time of day, and is determined by evaluation of the data taken during calibration. If v(s,t) is the speed, at time t, of a vehicle starting at time s, s is then the start of a length of travel which may overlap several segments. Because of the restraints always affecting vehicle travel, v(s,t) is essentially band-limited for each s. The spectrum V(s,f) of v(s,t) then reflects the frequency content of v(s,t). The graph of FIG. 3 shows the Fourier transform of the speed along a segment. This produces the distribution |V(s, f)| for a fixed s.

Figure 4:
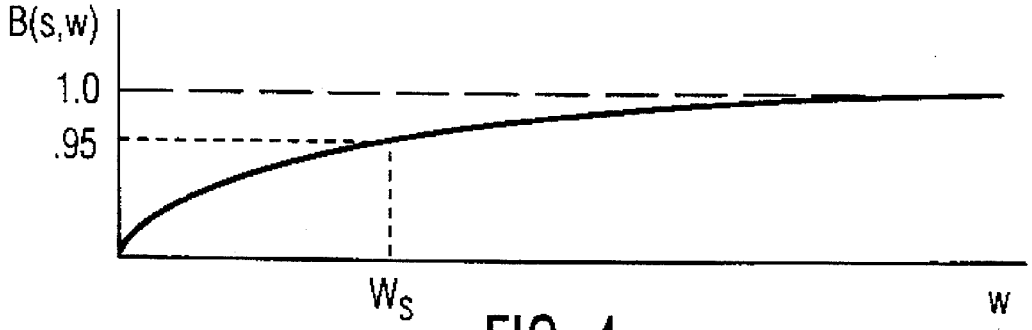
FIG. 4 is a graph of the ratio of energy in a given bandwidth to the energy in the entire speed signal for the segment of FIG. 3.
Figure 5:
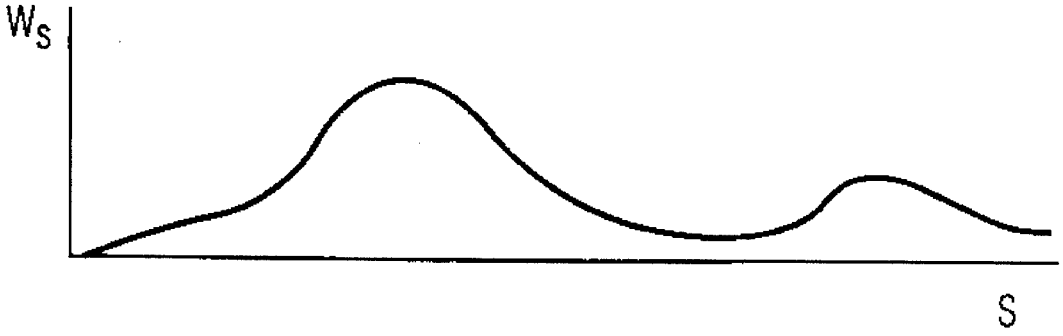
FIG. 5 is a graph showing a time varying bandwidth for the route segment.

To determine what is a "normal" variation from the mean, the graph of FIG. 4 shows the ratio B(s,w) of the energy in the bandwidth from 0 (zero) to w, to the entire energy, as a function of the bandwidth w. More simply put, it is the area under the curve of FIG. 3 that is included by setting limits between 0 (zero) and a fixed frequency w divided by the total area. In this context, energy is defined as the integral of the square of the absolute value of the Fourier Transform of the speed signals and is the full area under the curve of FIG. 3. It is given by the equation $$E=\int_{0}^{+\infty}|V(s,f)|^2\,df.$$

Assuming that a value B(s,W(s))=0.95 is a good compromise between cost of extensive reporting, and ineffective monitoring, a sampling time or Nyquist rate would be T(s)=1/(2W(s)). Assuming a slow variation of T(s) over a suitable interval of time, T(s) may be used as the time interval for dispatch or selection of probe vehicles during the monitoring phase. The Nyquist-Shannon theorem can then be used to reconstruct v(s,t) from the samples {v(c,T(s), v(s,2T(s)), . . . , } transmitted by the probe vehicle during the monitoring phase.

The data collected for a given route segment during the calibration period may be evaluated by providing a "graph" showing the mean and the variance of bandwidth as a function of coarse time and location; but it is likely that a weather axis, a holiday axis, or others may also be employed. The velocity patterns of days with different characteristics may be essentially the same; in that case one pattern should be used for both. Other pattern relationships may also be discernible; for example, one or a succession of below-average-speed days on a given route may frequently be followed by an above-average speed day because motorists tend to change their route selection because of the immediately prior bad travel days. In such a situation the standard for reporting "abnormal" conditions would be altered for the anticipated above-average-speed day.

By comparing the model produced if data from less than all of the calibrant vehicles are used, the degradation of accuracy with reduction in number of reporting vehicles can be determined. This can be used to improve the cost-accuracy trade-off during later sequences of the calibration stage, as well as during the monitoring phase.

Monitoring Phase

On-line monitoring and reporting activity can start more-or-less as soon as the calibration phase is completed. To give the exact number and frequency of deployment for a given route segment, the bandwidth of an origin-destination pair directly gives the probe coverage needed for a given accuracy.

The equipment used for this phase, shown in FIG. 2, preferably differs substantially in numbers, and somewhat in kind, from that used for calibration. Each probe vehicle 110 has a GPS receiver 12 and antenna 13, a differential data receiver 16 and its antenna 15, and a cellular phone 22 with antenna 23 which may be identical to those previously used in a calibrant vehicle. However, the probe computer 118 is provided (or down-loaded by telephone/modem communication) with a stored record of bandwidth patterns for one or all of the routes, and is programmed and connected to transmit its speed data automatically over the cellular phone 22 whenever the measured bandwidth differs from the mean bandwidth obtained from the calibration phase by a programmed amount. The bandwidth is measured in real time as the probe travels over each segment.

Pattern selection can be fully automatic when the day is "normal" for that route. As is now commonplace, the computer 118 has an internal clock and calendar. Holiday and major special events are known so far in advance that they will be part of the programmed data which are provided on a periodic basis, preferably by mailing up-date data on floppy discs or the equivalent. Even routes which are affected by major sporting events will have patterns established, during the calibration period, which take into account the impact on traffic flow. Each day is expected to follow one of the patterns of mean and standard deviation of speed, as a function of time and location, which is predicted for that type of day.

Observed speed data are stored in the computer 118 only to gather data which indicates a specific mean and variance for the current segment (location). Any speed outside the acceptable variation will cause the probe system to call, via the commercial telephone network including a transceiver 130, to a central computer 140.

The central computer 140 is programmed to provide information on speed; or more significantly, on places where speed is outside normal speeds, via a display 142. Additionally, the computer will automatically activate selected probe vehicles, by messages transmitted over the cellular telephone network, in order to have sufficient number of active probes in each significant segment of a route. Further, if the computer is unable to activate sufficient probe vehicles, it will provide an alarm and specific information over the display 142, so that a dispatcher can take specific action, which might include dispatching one or more special probe vehicles.

Activation of a probe vehicle presupposes that one is available. During the monitoring phase, in a system according to the invention a relatively large number of vehicles will be equipped so that they can serve as probe vehicles. Desirably, these vehicles are selected because they will normally or frequently be operating on routes of interest at times of interest, independent of their status as probe vehicles. Examples might be commuter buses, delivery vehicles, or private automobiles frequently used for commuting. These vehicles will be equipped as probes 110. In one preferred mode of operation, upon entering any route which is normally monitored, the probe computer 118 will automatically seek to communicate, via the phone 22 and any transceiver 130 within operational range, with the central computer 140 to register as available for activation. The computer will then reply, confirming the contact, and directing activation or directing that this probe not communicate further.

In another mode of operation, using essentially the same equipment, the transceivers 22 and 130 are not operated as part of a general purpose cellular telephone system, but use one or more channels or time slots of a mobile radio system. The receiving stations can be satellite transceivers, or cellular spaced transceivers having restricted service channels or time slots. In this mode, for example, the central computer 140 may select a particular cellular transceiver whose operational range covers a route segment for which data are desired, and transmit a coded request for probes, which are within range and are on that route segment, to reply. Any of the well known techniques for preventing or reducing collisions between replying transceivers 22 may be implemented. If too many probes reply, the computer will select those to activate, and those to refrain from automatic transmission of variance data.

According to another aspect of the invention, during the monitoring phase the computer will transmit, to one or to all probes listening, control information for changing the speed and variance for one or more route segments, where information from probe vehicles or from outside sources suggest that a different pattern is to be expected. A common example of this situation is area-wide inclement weather, or weather which is expected to affect or is now affecting one route or region. The change can either be a specific quantitative change, or can be directing use of a different stored pattern.

Another trigger to substitution of alternative patterns is on-board sensing. For example, continuous operation of windshield wipers, if sensed, may cause the computer to switch automatically to a "rainy day" pattern; however, if an on-board thermometer senses an exterior temperature which is close to or below freezing, a snow/ice pattern may be substituted. Following the principle that data are transmitted only when there is a deviation from the expected pattern, some or all probe vehicles may be equipped to sense temperature, wiper operation, or brightness/darkness, and to transmit a "conditions deviation" signal if this condition is not consistent with the pattern which had been in use. Dead reckoning can be used to supplement GPS when the terrain (for example, tunnels or tall buildings) blocks GPS reception.

In another operating variation, the central computer 140 can infer the current state of traffic flow by recording the last car that "calls in" as the valid speed. This information should, in turn, be transmitted to later probes so that when traffic returns to "normal" a call is received to that effect. Such a mode is particularly useful if a vehicle breakdown or minor accident has created a very abnormal flow, which is corrected by people at the scene without the knowledge of or any action by police, tow trucks, or the like.

A further aspect of the invention is automatic up-dating. Even though the number of vehicles used as probes will normally be smaller than that used as calibrant vehicles, changes in the bandwidth, noted as a pattern of variances, can automatically be used to adjust the pattern model for the type of day or route. Only when a major permanent change occurs suddenly, such as the opening of an additional highway, is there reason to provide a new calibration phase.

Dissemination of information obtained from practice of the invention can be by any well-known technique. Some highways already have low-power transmitters, operating in channels of the radio broadcasting bands, for local traffic or other information. Message up-dates can be provided on these transmitters directly under control of the computer in the central station; or can be directed by a system dispatcher. The display 142 can use automatically presented maps on a monitor or a board, with color or number indications of trouble spots; or can include a plain text message describing variance information, and indicating possible explanations for this variation based on similarity of the variation to some stored pattern of past recurring or unique occurrences.

When a probe vehicle is operating on a route which has no calibration data, reporting would ordinarily be suppressed. However, a driver-operable override can be provided, to cause the on-board transceiver to attempt to communicate automatically when the driver believes that the situation is abnormal and deserves reporting. In this situation, the extreme accuracy of the GPS location signal allows the central computer 140 to determine that the location reported is in fact a driving lane of a roadway; and exactly where and what the speed pattern is. This permits not only dissemination of traffic information about such roads, but also may pinpoint a condition requiring investigation by police.

A further variation of the above operating mode permits automatic attempted override reporting whenever the on-board system identifies an extended period of limited or no movement while on a route of interest. Normally such a situation is the result of an accident or the like where locating the cause may be difficult unless aerial observation is possible. The automatically reported data, if accepted by the computer, can provide valuable identification of the extent or location of a serious abnormality, long before other normally activated probes may start sending data. Furthermore, since the accuracy permits distinguishing between points on a driving lane and points on a highway shoulder, and the duration of the occurrence, the authenticity of the automated reporting makes the report credible.

Although the system may be operating nominally in the monitoring phase, it is possible to continue to refine calibration during day to day operations by using the probe fleet in the calibration mode. Further, if a probe vehicle is operated off the normal paths or terrain, it may be desirable to include data on that route for the database.

Other embodiments

The Global Positioning System is described as the source of location information because it is the best system now known for obtaining position information, with sufficient accuracy, that is fully automatic, provides results easily processed by computers, and does not require special installations along a path or roadway. However, it is clear that many other methods of providing position information are possible and may become available or be installed in the near future. During the calibration phase it may be possible to acquire data from which location as a function of time can be determined through use of an on-board inertial navigation system. Such a system might be too expensive for installation in probe vehicles, but would not suffer the disadvantage of signal blocking in tunnels or in relatively narrow roadways between tall buildings. During the calibration or monitoring phases, "dead reckoning" data may be supplemented by sensing location identifier signals transmitted at checkpoints from a coil or a small directional antenna. For example, vehicle speed can be sensed accurately by a wheel speed sensor and, when integrated with vehicle steering angles, can provide fairly accurate dead reckoning position information for the distance between checkpoints.

The cellular phone 22 may also be used for direct communication between the vehicle driver and personnel at the computer station, to report extraordinary occurrences, so that they may be considered in the overall evaluation, or may be used to alter instructions which may be given over that same phone to the vehicle operator.

When applied to other situations besides motor vehicles on a roadway, the invention merely requires that calibrants be able to acquire data from which accurate time and location information can be determined, and have respective means for storing and transmitting the information during a calibration phase. During monitoring a sufficient number of probes must be available, each having access to data from which time, location and speed can be determined, computing capability for storing patterns of speed and bandwidth, and equipment for transmitting data relating to out-of-band conditions to a receiving station so that evaluation of individual reports and corrective action, warnings, or the like are possible. Thus the invention could even be applied to movement of people on foot in a large terminal or building complex having well-defined corridors and stairwells. In this situation altitude data, or some other indication of the floor level or particular flight in a stack of stairs, will usually be required in addition to position on a surface.

What is claimed is:

1. A method of estimating quantitive data describing the flow of traffic, comprising the steps of:

a) providing a plurality of calibrant vehicles, b) providing each calibrant vehicle with respective means for acquiring data from which speed of the calibrant vehicle at different times and locations can be determined; and for transmitting the acquired data to a receiving station, c) providing at least one receiving station having means for receiving said data transmitted by respective calibrant vehicles, d) at spaced times approximately equal to predetermined times of a respective day, dispatching a respective calibrant vehicle for operation over a substantially predetermined route, e) during at least the portion of the day that each respective vehicle is being operated over said route, controlling said respective vehicle to record said data, f) transmitting the recorded data to said at least one receiving station, g) computing subsegment speed samples for each calibrant vehicle from which said data have been received, and determining baseline data having a time-varying bandwidth descriptive of traffic conditions on respective segments of said route for at least one combination of time of day and traffic conditions, h) analyzing said data received from said calibrant vehicles to determine the relationship between the number of said calibrant vehicles and the reliability of traffic flow estimation based thereon, and selecting a first number of probe vehicles whose reporting will provide a given reliability of traffic flow estimation, i) then deploying said number of probe vehicles at least one time of day and traffic conditions corresponding to said at least one combination, each probe vehicle having respective means for acquiring data from which subsegment information including the speed of that probe vehicle at different times and locations can be determined, j) in response to predetermined criteria, controlling at least one of said probe vehicles to transmit said subsegment information, and k) computing estimated traffic flow along at least one segment of said route based at least partly on the transmitted subsegment information.

2. A method as claimed in claim 1, characterized in that step i) comprises providing each probe vehicle with means for determining the location of the respective vehicle; causing each probe vehicle to determine its location at respective instants of time separated by intervals of approximately a given period of time, recording probe data corresponding to the determined location and the corresponding instant of time, and determining and recording subsegment information based at least in part on said probe data.

3. A method as claimed in claim 2, characterized in that each probe vehicle comprises a respective radio transmitter, the step of controlling at least one of said probe vehicles comprises controlling the respective radio transmitter to transmit the respective subsegment information in a respective time slot over a radio channel, and said subsegment information is stored in said one of said probes no later than the next occurring respective time slot for that probe in which transmission is successful.

4. A method as claimed in claim 3, characterized in that a plurality of receiving stations are provided, having overlapping operational ranges, each receiving station including means for transmitting control and confirmation signals, in response to said predetermined criteria, said one of said probe vehicles transmits said subsegment information, upon receipt of a confirmation signal from a receiving station, the probe repeats the step of determining its location, recording probe data, and determining and recording subsegment information, and upon failure to receive a confirmation signal, the probe transmits said subsegment information during the next occurring respective time slot.

5. A method as claimed in claim 1, wherein a multiplicity of probe vehicles are provided, each probe vehicle being operated at the discretion of the respective vehicle operator, further comprising the steps of transmitting an identification signal from a given probe vehicle when it is placed into operation on a said route, upon receipt of said identification signal by said one receiving station, determining if said given probe vehicle is within operational range, determining if the number of probe vehicles already communicating on routes within operational range of said one receiving station is less than said first number, and upon determination that said number of probe vehicles already communicating is less than said first number, transmitting control signals to said given probe vehicle to cause at least one further transmission from said given probe vehicle.

6. A method as claimed in claim 1, characterized in that step b) comprises providing each calibrant vehicle with respective means for determining the location of the respective vehicle at respective instants of time separated by intervals of approximately a given period of time, for determining the time of each said respective instant, and for recording data corresponding to the determined location and said time for each respective instant; and respective means for transmitting the recorded data.

7. A method as claimed in claim 6, characterized in that each calibrant vehicle records and stores data for each of said instants of time while being operated over at least a segment of the entire predetermined route, prior to transmitting the stored data to said receiving station.

8. A method as claimed in claim 6, characterized in that each calibrant vehicle records and stores data for each of said instants of time while being operated over the entire predetermined route, prior to transmitting the stored data to said receiving station.

9. A method of estimating quantitive data describing the flow of traffic, comprising the steps of:

a) providing a plurality of calibrant vehicles, b) providing each calibrant vehicle with respective means for determining the location of the respective vehicle at respective instants of time separated by intervals of approximately a given period of time, for determining the time of each said respective instant, and for recording data corresponding to the determined location and said time for each respective instant; and respective means for transmitting the recorded data, c) providing at least one receiving station having means for receiving said data transmitted by respective calibrant vehicles, d) at spaced times approximately equal to predetermined times of a respective day, dispatching a respective calibrant vehicle for operation over a substantially predetermined route, e) during at least the portion of the day that each respective vehicle is being operated over said route, controlling said respective vehicle to record said data, f) transmitting the recorded data to said at least one receiving station, g) computing subsegment speed samples for each calibrant vehicle from which said data have been received, and determining baseline data having a time-varying bandwidth descriptive of traffic conditions on respective segments of said route for at least one combination of time of day and traffic conditions, h) analyzing said data received from said calibrant vehicles to determine the relationship between the number of said calibrant vehicles and the reliability of traffic flow estimation based thereon, and selecting a first number of probe vehicles, less than the number of said plurality of calibrant vehicles, whose reporting will provide a given reliability of traffic flow estimation, i) then deploying a second number of probe vehicles at least one time of day and traffic conditions corresponding to said at least one combination, each deployed probe vehicle having respective means for determining the location of the respective vehicle at respective instants of time separated by intervals of approximately a given period of time, for determining the time of each said respective instant, for computing average subsegment speed between the most recent determination of location and the previous determination for that probe vehicle, and for comparing said average subsegment speed with said baseline data having a time-varying bandwidth descriptive of traffic conditions on the segments of said route in which the latest location lies, and for determining whether that average subsegment speed is a normal value falling within said bandwidth for the combination of time of day, segment and traffic conditions, j) responsive to determination that a given probe vehicle's subsegment speed is an abnormal speed not falling within said bandwidth, controlling said means for transmitting in said given probe vehicle to transmit information related to the computed subsegment speed, and k) computing estimated traffic flow along at least one segment of said route based at least in part on the transmitted information.

10. A method as claimed in claim 9, further comprising controlling each of said second number of probe vehicles to transmit a request for recognition automatically when the respective probe vehicle is put into an operating mode on said route, providing at least one receiving station having means for receiving transmissions from respective probe vehicles, upon receipt of said request for recognition by said at least one receiving station, determining whether a number of probe vehicles equal at least to said second number have transmitted requests for recognition, and responsive to the number of probe vehicles requesting recognition exceeding said second number, transmitting a control message not to transmit further information.

11. A method as claimed in claim 9, further comprising controlling each of said second number of probe vehicles to transmit a request for recognition automatically when the respective probe vehicle is put into an operating mode on said route, providing at least one receiving station having means for receiving transmissions from respective probe vehicles, counting the number of said requests for recognition received by the receiving stations, and comparing the counted number to said second number, and responsive to the counted number being less than said second number, providing an alert indication to a system operator.

12. A method as claimed in claim 1, further comprising:

storing in said probe vehicle at least one bandwidth determined for a given segment corresponding to a given combination of time of day and traffic conditions, said predetermined criteria including the criterion that said probe vehicle's speed is an abnormal speed not falling within said bandwidth.

13. A method as claimed in claim 1, further comprising:

sensing a condition in addition to the data from which probe vehicle speed can be determined, said predetermined criteria including the criterion that said condition is inconsistent with a given pattern.

14. A method as claimed in claim 1, wherein estimated traffic flow is based on the transmitted subsegment information and predictions for a given type of day.

15. A method of estimating quantitive pattern data describing the flow of traffic, comprising the steps of:

a) providing a plurality of calibrant vehicles, b) providing each calibrant vehicle with respective means for acquiring data from which speed of the calibrant vehicle at different times and locations can be determined; and for transmitting the acquired data to a receiving station, c) providing at least one receiving station having means for receiving said data transmitted by respective calibrant vehicles, d) at spaced times approximately equal to predetermined times of a respective day, dispatching a respective calibrant vehicle for operation over a substantially predetermined route, e) during at least the portion of the day that each respective vehicle is being operated over said route, controlling said respective vehicle to record said data, f) transmitting the recorded data to said at least one receiving station, g) computing subsegment speed samples for each calibrant vehicle from which said data have been received, and determining baseline data having a time-varying bandwidth descriptive of traffic conditions on respective segments of said route for at least one combination of time of day and traffic conditions.

16. A method as claimed in claim 15, characterized in that step b) comprises providing each calibrant vehicle with respective means for determining the location of the respective vehicle at respective instants of time separated by intervals of approximately a given period of time, for determining the time of each said respective instant, and for recording data corresponding to the determined location and said time for each respective instant; and respective means for transmitting the recorded data.

17. A method as claimed in claim 16, characterized in that each calibrant vehicle records and stores data for each of said instants of time while being operated over at least a segment of the entire predetermined route, prior to transmitting the stored data to said receiving station.

18. A method as claimed in claim 16, characterized in that each calibrant vehicle records and stores data for each of said instants of time while being operated over the entire predetermined route, prior to transmitting the stored data to said receiving station.

19. A method of estimating quantitive data describing the flow of traffic along a route, comprising the steps of:

a) determining baseline data having a time-varying bandwidth descriptive of traffic conditions on respective segments of said route for at least one combination of time of day and traffic conditions, b) analyzing said baseline data to determine the relationship between the number of probe vehicles and the reliability of traffic flow estimation based thereon, and selecting a first number of probe vehicles whose reporting will provide a given reliability of traffic flow estimation, c) deploying a plurality of probe vehicles at respective times approximating the time of day and traffic conditions corresponding to said at least one combination, d) causing each deployed probe vehicle to acquire data from which subsegment information including the speed of that probe vehicle at different times and locations can be determined, to compare subsegment speed with said baseline data having a time-varying bandwidth descriptive of traffic conditions on the segments of said route in which the latest location lies, and to determine whether that subsegment speed is a normal value falling within said bandwidth for the combination of time of day, segment and traffic conditions, e) responsive to determination that a given probe vehicle's subsegment speed is an abnormal speed not falling within said bandwidth, controlling said means for transmitting in said given probe vehicle to transmit information related to the computed subsegment speed, and f) computing estimated traffic flow along at least one segment of said route based at least in part on the transmitted information.

20. A method as claimed in claim 19, characterized in that step d) comprises determining the location of the respective vehicle at respective instants of time separated by intervals of approximately a given period of time; determining the time of each said respective instant; computing average subsegment speed between the most recent determination of location and the previous determination for that probe vehicle; comparing said average subsegment speed with said baseline data having a time-varying bandwidth descriptive of traffic conditions on the segments of said route in which the latest location lies; and determining whether that average subsegment speed is a normal value falling within said bandwidth for the combination of time of day, segment and traffic conditions.

21. A method as claimed in claim 19, wherein a multiplicity of probe vehicles are provided, each probe vehicle being operated at the discretion of the respective vehicle operator, further comprising the steps of transmitting an identification signal from a given probe vehicle when it is placed into operation on a said route, upon receipt of said identification signal by said one receiving station, determining if said given probe vehicle is within operational range, determining if the number of probe vehicles already communicating on routes within operational range of said one receiving station is less than said first number, and upon determination that said number of probe vehicles already communicating is less than said first number, transmitting control signals to said given probe vehicle to cause at least one further transmission from said given probe vehicle.

22. A probe vehicle for estimating quantitive data describing the flow of traffic along a route, comprising:

a) means for receiving and storing baseline data having a time-varying bandwidth descriptive of traffic conditions on respective segments of said route for at least one combination of time of day and traffic conditions, b) means for determining if said probe vehicle is being operated along said route at a time approximating the time of day and traffic conditions corresponding to said at least one combination, c) means for acquiring data from which subsegment information including the speed of that probe vehicle at different times and locations can be determined, for comparing subsegment speed with said baseline data having a time-varying bandwidth descriptive of traffic conditions on the segments of said route in which the latest location lies, and for determining whether that subsegment speed is a normal value falling within said bandwidth for the combination of time of day, segment and traffic conditions, d) means, responsive to determination that said probe vehicle's subsegment speed is an abnormal speed not falling within said bandwidth, for controlling said means for transmitting in said given probe vehicle to transmit information related to the computed subsegment speed.

23. A vehicle as claimed in claim 22, characterized in that step d) comprises determining the location of the respective vehicle at respective instants of time separated by intervals of approximately a given period of time; determining the time of each said respective instant; computing average subsegment speed between the most recent determination of location and the previous determination for that probe vehicle; comparing said average subsegment speed with said baseline data having a time-varying bandwidth descriptive of traffic conditions on the segments of said route in which the latest location lies; and determining whether that average subsegment speed is a normal value falling within said bandwidth for the combination of time of day, segment and traffic conditions.

* * * * *